United States Patent [19]

Leclerc

[11] Patent Number: 4,880,079

[45] Date of Patent: Nov. 14, 1989

[54] LADDER CAP

[76] Inventor: Roland P. Leclerc, 735 Ford Dr., Sault Ste. Marie, Mich. 49783

[21] Appl. No.: 239,227

[22] Filed: Sep. 1, 1988

[51] Int. Cl.[4] ..... E06C 7/48

[52] U.S. Cl. ..... 182/107; 182/214

[58] Field of Search ..... 182/107, 108, 214

[56] References Cited

U.S. PATENT DOCUMENTS

| | | | |
|---|---|---|---|
| 2,868,427 | 1/1959 | Hess | 182/107 |
| 2,904,128 | 9/1959 | Boham | 182/108 |
| 4,469,194 | 9/1984 | McBride | 182/107 |
| 4,491,192 | 1/1985 | Skarsten | 182/107 |
| 4,580,660 | 4/1986 | Oling | 182/107 |

*Primary Examiner*—Reinaldo P. Machado

*Attorney, Agent, or Firm*—Douglas S. Bishop

[57] ABSTRACT

A device for use with a ladder comprising one cylindrical member with horizontally spaced apertures in said cylindrical member to accept the top ends of the rails of the ladder when the invention is placed horizontally thereon. The invention is affixed to the ladder by a pliable strap or straps with fastening means and may be permanently mounted or easily removed as required.

8 Claims, 1 Drawing Sheet

LADDER CAP

BACKGROUND OF THE INVENTION

The attachment of a device to ladder uprights to provide additional safety or stability features or to minimize damage to a vertical planate surface is generally known. Illustrations of prior art setting forth such embodiments are U.S. Pat. No. 4,491,192 to Skarsten; U.S. Pat. No. 4,331,217 to Stecklow; U.S. Pat. No. 4,339,020 to Wiseman; U.S. Pat. No. 4,469,194 to McBride; U.S. Pat. No. 4,600,079 to McBride; U.S. Pat. No. 3,419,109 to Costlow, et al; U.S. Pat. No. 4,159,045 to Brooks; and U.S. Pat. No. 4,444,291 to McPherson. Adaptations of this concept have included ladder supports mounted in pairs to the vertical rails or stiles of a ladder, as in the second McBride Patent, listed above; a resilient support attached to the upper rung of a ladder, as in the first McBride Patent, listed above; a combination support step and stabilizer bar, as in the Stecklow Patent, listed above; and a transverse, telescopical support device, as in the Skarsten Patent, also listed above.

Such existing devices are usually constructed of aluminum, wood or other materials from which conventional ladders are made. They tend to be complex in the manner in which they must be affixed to the ladder for each use, requiring utilization of screws, clamps or other time-consuming means of affixation. Existing devices which do not require such time-consuming affixation still generally require adjustment and attachment prior to each use and removal for separate transport and storage. Additionally, many of the prior art applications protrude from the ladder to which they are affixed, changing the attitude or pitch of the ladder against the vertical surface and substituting one safety problem for another. Further, the prior art applications, in distributing the weight of the ladder, tend to either utilize planate support members or support members which distribute weight to a plurality of specific points. None of the prior art utilizes the concept of distributing ladder weight equally along the entire length of an outwardly cylindrical support member to maximize stability and to minimize damage to the vertical surface contacted by the ladder.

The existing prior art fails to provide an apparatus which combines the required benefits of ladder safety and stability with minimization of damage by the ladder to the vertical planate surface which is contacts during use; which can be attached simply and quickly without additional tools; and which can be removed or may be retained on the ladder for transport and storage.

Accordingly, a need exists for a ladder cap attachment, of basic one-piece design, which may be attached without additional tools or apparatus, which may be easily removed, or, alternatively, retained on the ladder for transport and storage, which does not require a significant change in the pitch of the ladder against the vertical surface, and which performs the dual functions of increasing safety and stability and decreasing damage to the vertical surface.

DISCLOSURE OF THE INVENTION

The present invention satisfies the need hereinbefore set forth by providing a ladder cap attachment having one primary cylindrical member having horizontally spaced apertures capable of receiving the ends of ladder uprights.

The primary cylindrical member is sufficiently greater in length than the space between the ladder uprights to provide safety and stability. During use, while the ladder is in an upright position, the device is gravitationally held in place without necessity of screws, clamps, or other means. If desired during use, and, otherwise, during transport and storage, the device may be held in place by a strap or straps securing the device to the uppermost rung of the ladder.

Other objects, advantages and novel features of this invention will be set forth and will become apparent in the detailed description which follows and with reference to the accompanying drawings, in which.

A preferred form of the invention is shown by reference to the drawings in particular.

Figure 1:
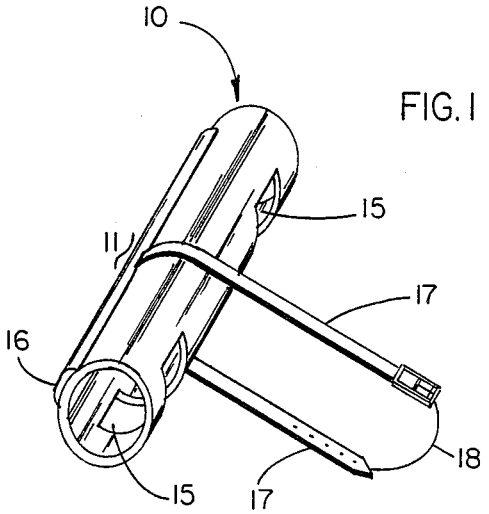
FIG. 1 is a perspective view of a preferred embodiment of the invention.
Figure 2:
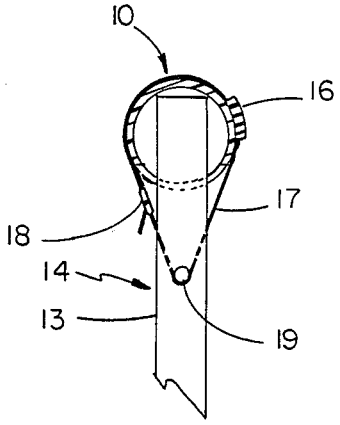
FIG. 2 is a side elevational view illustrating the use of the invention on a ladder inclined against a vertical wall.
Figure 3:
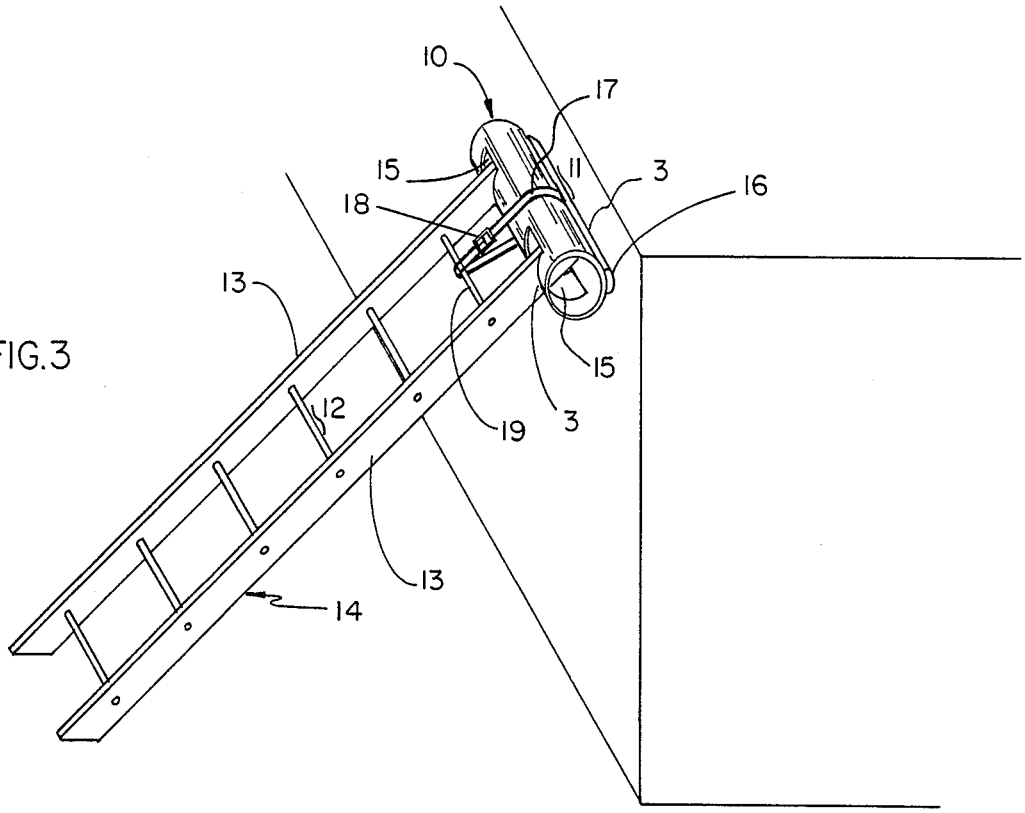
FIG. 3 is a sectional view of line 3—3 of FIG. 2, with the attached ladder partly broken away.

The Ladder Cap comprises a principal, cylindrical member 10 of a length 11 in excess of the distance 12 between the rails 13, or stiles, of the ladder 14 to which it is attached. The principal cylindrical member has two horizontally spaced apertures 15. The apertures 15 are horizontally separated a distance corresponding to the approximate distance 12 between the rails 13, or stiles, of a ladder 14 to which the principal cylindrical member 10 is attached. The horizontal width of the apertures 15 is greater than the width of the ladder rails 13, or stiles, and may be of sufficient width to allow application of the invention with a variety of ladder widths, both greater or lesser than the width of the ladder 14 shown. The principal cylindrical member 10 is placed horizontally across the uppermost ends of the ladder 14, each horizontally spaced aperture 15 providing a female fitting and each uppermost end of the ladder rails 13, or stiles, providing a male fitting. As is indicated by FIG. 2, when the ladder is in an operating, upright position, the ends of the rails 13, or stiles, contact the inner surface of the primary cylindrical member 10. The device is thus held in place gravitationally without requirement of additional fastening means. In this preferred embodiment, the invention provides additional stability and safety in the utilization of the ladder by ensuring continual horizontal contact with the vertical surface and by distributing the ladder weight over the entire length of the principal cylindrical member 10 and over a length in excess of the normal width 12 between the rails 13, or stiles. In the same manner, by distributing the weight equally over the entire length of the principal cylindrical member 10 and by providing a uniform cylindrical exterior surface at all points of contact, damage to the vertical surface is minimized.

In a further embodiment of the invention, a uniform resilient pad 16 of rubber, foamed plastic, or other material is affixed to the exterior surface of the primary cylindrical member 10. Said pad 16 further prevents marring of the vertical surface, enhances equal load distribution on an uneven vertical surface, and decreases lubricity on a smooth or slick surface.

In a further embodiment of the invention, affixed to the primary cylindrical member 10 are a plurality of straps 17, each having at its end a means 18 for securing same, such as a buckle, snaps or velcro strips. Said straps are passed around the uppermost horizontal rung 19 of the ladder 14 and secured to hold the primary cylindrical member 10 in place. Because such a retaining function is not necessary in actual use of the ladder 14 with the invention and is primarily designed for retaining the device in place during transport or storage, any strap material which will support the weight of the primary cylindrical member 10 is sufficient.

What is claimed is:

1. A ladder attachment disposed to be placed horizontally across the top of the ladder rails, or stiles, to provide a uniform outwardly cylindrical contact member for additional support and stability and protection of the surface against which the ladder is inclined, comprising a unitary cylindrical member of a length greater than the distance between the rails of a ladder; said cylindrical member having two horizontally spaced apertures sufficient to receive and gravitationally retain the uppermost ends of the ladder rails.

2. A ladder attachment as set forth in claim 1, further comprising a uniform resilient pad of rubber, foamed plastic, or other material over the exterior surface of said cylindrical member.

3. A ladder attachment as set forth in claim 1, further comprising:

(a) a plurality of straps affixed to the unitary cylindrical member;

(b) means for securing said straps around the uppermost rung of the ladder.

4. A ladder attachment as set forth in claim 1 wherein the two horizontally spaced apertures are of sufficient greater width than the ladder rails to allow said apertures to receive and retain ladders of greater or lesser overall width.

5. A ladder attachment as set forth in claim 1, wherein the cylindrical member is formed of molded plastic.

6. A ladder attachment as set forth in claim 3, wherein the means for securing said straps around the uppermost rung of the ladder comprises one or more of: a buckle, snaps or velcro strips.

7. A ladder attachment as set forth in claim 3, wherein said straps are formed of one or more of: leather, rubber, plastic, fabric.

8. An attachment for use in conjunction with a ladder of the type comprising a pair of elongated rails connected by a plurality of spaced-apart rungs disposed at approximate right angles thereto, said attachment comprising:

a one-piece cylindrical member of a length greater than the distance between the rails of the ladder said cylindrical member having a pair of openings displaced along the length thereof in an approximate linear relationship; said openings spaced apart by a distance approximately equal to the distance between the rails of the ladder and each being sufficiently large to receive an end of a rail therein;

a body of resilient material covering substantially all of the length of at least a portion of the circumference of said cylindrical member; and a strap affixed to the cylindrical member and including securing means for fastening said strap to a rung of the ladder.

* * * * *